US007556316B1

(12) United States Patent
Lai

(10) Patent No.: US 7,556,316 B1
(45) Date of Patent: Jul. 7, 2009

(54) ELEVATING STRUCTURE FOR ARMRESTS

(76) Inventor: Yu-Shan Lai, No. 632, Sec. 1, Shihsian Rd., West District, Chiayi City 600 (TW)

( * ) Notice: Subject to any disclaimer, the term of this patent is extended or adjusted under 35 U.S.C. 154(b) by 12 days.

(21) Appl. No.: 12/057,435

(22) Filed: Mar. 28, 2008

(51) Int. Cl.
*B60N 2/46* (2006.01)

(52) U.S. Cl. ..... 297/411.36; 297/411.2; 297/411.35

(58) Field of Classification Search ..... 297/411.2, 297/411.36, 411.35
See application file for complete search history.

(56) References Cited

U.S. PATENT DOCUMENTS 5,388,892 A * 2/1995 Tornero ..... 297/411.36
6,209,840 B1 * 4/2001 Chen ..... 248/407
6,336,680 B1 * 1/2002 Lee ..... 297/411.36
6,394,553 B1 * 5/2002 McAllister et al. ..... 297/411.36
6,419,323 B1 * 7/2002 Chu et al. ..... 297/411.36
6,585,322 B1 * 7/2003 Lai ..... 297/411.36
6,974,189 B2 * 12/2005 Machael et al. ..... 297/411.36
6,974,190 B1 * 12/2005 Hung ..... 297/411.36
7,066,546 B2 * 6/2006 Trego et al. ..... 297/411.37
7,156,466 B1 * 1/2007 Chang ..... 297/411.36
7,306,288 B2 * 12/2007 Hu et al. ..... 297/411.36

* cited by examiner

*Primary Examiner*—Laurie K Cranmer
(74) *Attorney, Agent, or Firm*—Alan Kamrath; Kamrath & Associates PA

(57) ABSTRACT

An elevating structure for armrests includes an adjusting member including a main part having an engaging slot formed therein corresponding with a successive toothed groove mounted in an auxiliary part including a push button attached on the top end thereof for receiving a first spring. The first spring abuts against the main part, and the auxiliary part is pushed downward. Each tooth of the the toothed groove is provided with an inclined pushing surface corresponding to a locking recess arranged in the engaging slot. A rail member includes a lock member axially fixed thereon for being pressed by a second spring. A lid covers the lock member. The rail member further includes a window arranged thereon so that the lock projection is inserted into the rail member through the window. Thus, the lock projection is biased to engage with one of the locking recesses.

3 Claims, 5 Drawing Sheets

ELEVATING STRUCTURE FOR ARMRESTS

BACKGROUND OF THE INVENTION

1. Field of the Invention

The present invention relates to an elevating structure, and more particularly to an elevating structure for armrests that may facilitate height adjustment.

2. Description of the Prior Arts

Conventional armrests are provided to comfort a user as he sits on an armchair and puts his hands on the armrests. Thus, height adjustment based on different users is essential.

A conventional armrest includes an adjusting member and a rail member for retaining the adjusting member therein, both of which are assembled together in the armrest. The adjusting member includes a successive toothed groove formed therein, and the rail member includes a lock projection fixed thereon. Thus, when the adjusting member is moved upward, the toothed groove retains the lock projection, thereby positioning the armrest. However, while adjusting the adjusting member downward, a positioning element is moved with respect to the lock projection. Hence, the user has to pull the adjusting member toward the highest position and then to retain the lock projection in the tooth groove by using the positioning element. Thereafter, the adjusting member is pushed downward to the bottommost end so as to disengage the lock projection from the positioning element, thereby adjusting the armrest upward once more. Unfortunately, such a height adjustment is quite tedious.

The present invention has arisen to mitigate and/or obviate the afore-described disadvantages.

SUMMARY OF THE INVENTION

The primary object of the present invention is to provide an elevating structure for armrests that may facilitate height adjustment.

In accordance with one aspect of the present invention, there is provided an elevating structure for armrests comprising:

an adjusting member and a rail member for retaining the adjusting member therein, both of which are assembled together in an armrest, with the adjusting member including a main part and an auxiliary part moveable relative to each other;

the adjusting member includes the main part having an engaging slot formed therein for engaging with a successive toothed groove mounted in the auxiliary part, with the auxiliary part including a push button attached on the top end thereof and extending therefrom for receiving a first spring therein, such that the first spring abuts against the main part and to push the auxiliary part downward, and in the toothed groove of the auxiliary part is provided with an inclined pushing surface in response to a plurality of locking recesses arranged in the engaging slot; and the rail member is provided to receive the adjusting member and includes a lock member axially fixed thereon for being pressed by a second spring, with the rail member further including a lid for covering the lock member and further including a window arranged thereon so that the lock projection is inserted into the rail member through the window, such that the lock projection is biased to engage with one of the locking recesses.

The present invention will become more obvious from the following description when taken in connection with the accompanying drawings, which show, for purpose of illustration only, the preferred embodiment in accordance with the present invention.

DETAILED DESCRIPTION OF THE PREFERRED EMBODIMENT

Figure 1:
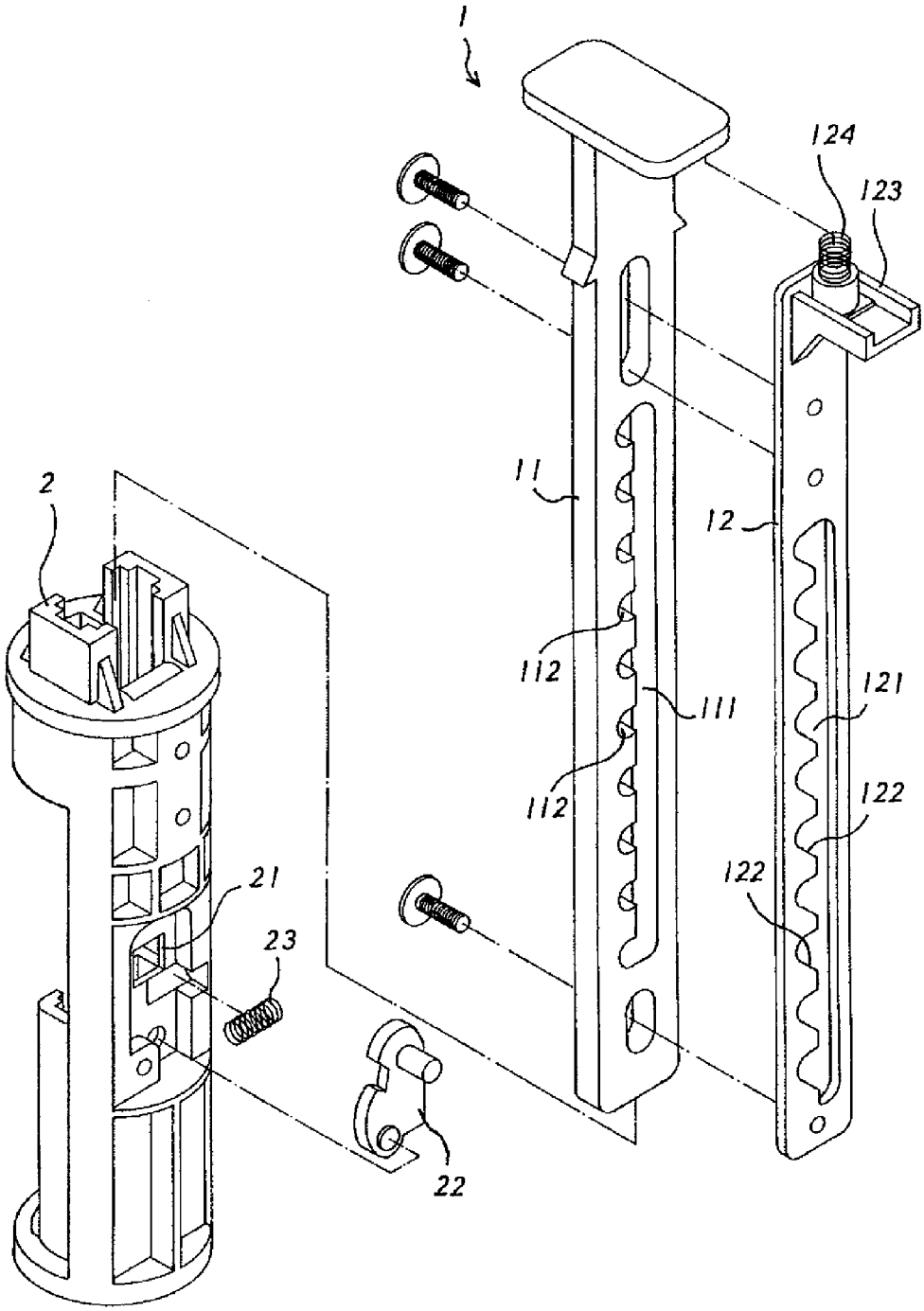
FIG. 1 is a perspective view illustrating the exploded components of an adjusting member and a rail member of an elevating structure for armrests according to the present invention.
Figure 2:
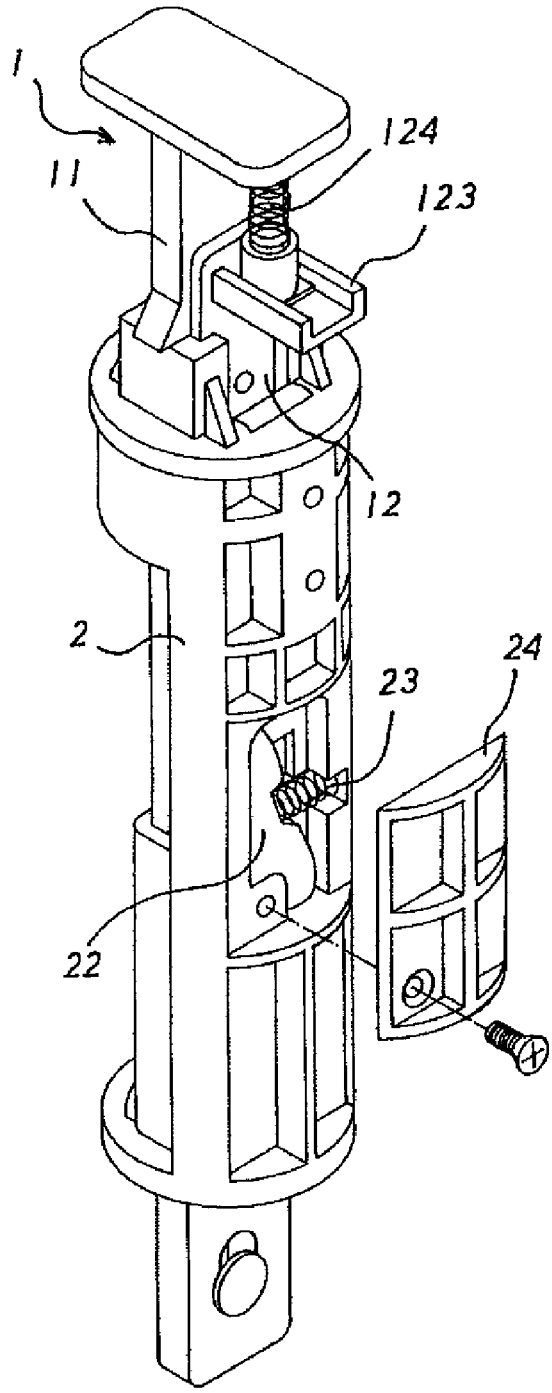
FIG. 2 is a perspective view illustrating the assembly of the adjusting member and the rail member of the elevating structure for armrests according to the present invention.
Figure 5:
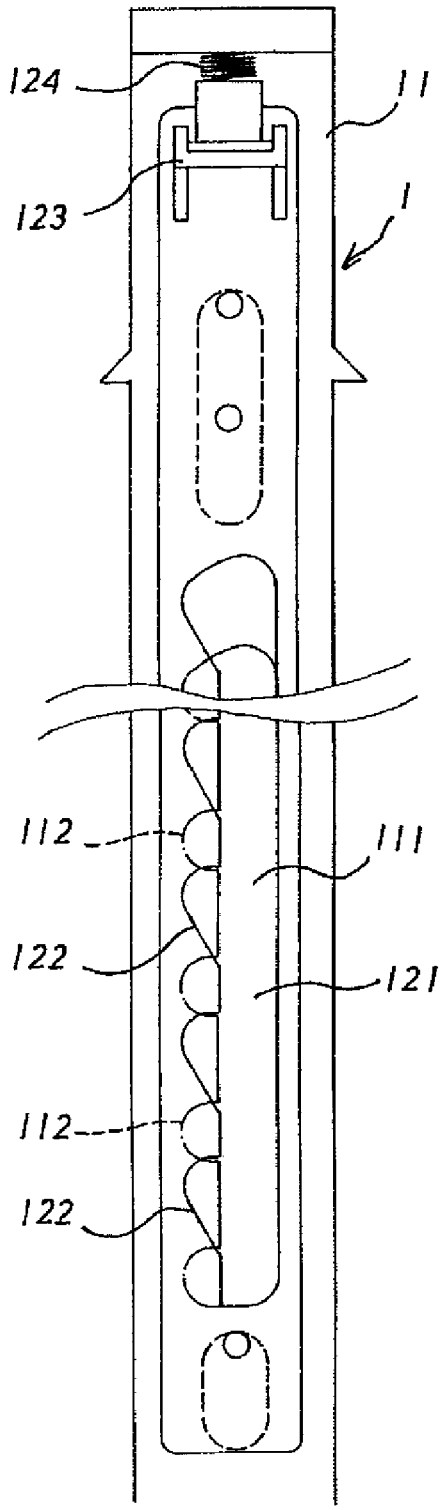
FIG. 5 is a cross sectional view illustrating the operation of the adjusting member of the elevating structure for armrests according to the present invention.

Referring to FIGS. 1 and 2, an elevating structure for armrests in accordance with the present invention comprises an adjusting member 1 and a rail member 2 for retaining the adjusting member 1 therein, both of which are assembled together in an armrest 100 (as illustrated in FIG. 5). The adjusting member 1 includes a main part 11 and an auxiliary part 12 moveable relative to each other.

The main part 11 has an engaging slot 111 formed therein corresponding with a successive toothed groove 121 formed in the auxiliary part 12. The auxiliary part 12 includes a push button 123 attached on the top end thereof and extending therefrom for receiving a first spring 124 therein. The first spring 124 abuts against the main part 11 so that the auxiliary part 12 is pushed downward. Each tooth of the toothed groove 121 of the auxiliary part 12 is provided with an inclined pushing surface 122 and corresponds to a locking recess 112 arranged in the engaging slot 111.

The rail member 2 is provided to receive the adjusting member 1 and includes a lock projection 22 pivotally mounted thereon for being pressed by a second spring 23. The rail member 2 includes a lid 24 for covering the look projection 22. The rail member 2 further includes a window 21 arranged thereon so that the lock projection 22 is inserted into the rail member 2 through the window 21. Thus, the lock projection 22 is biased to engage with one of the locking recesses 112.

Figure 3:
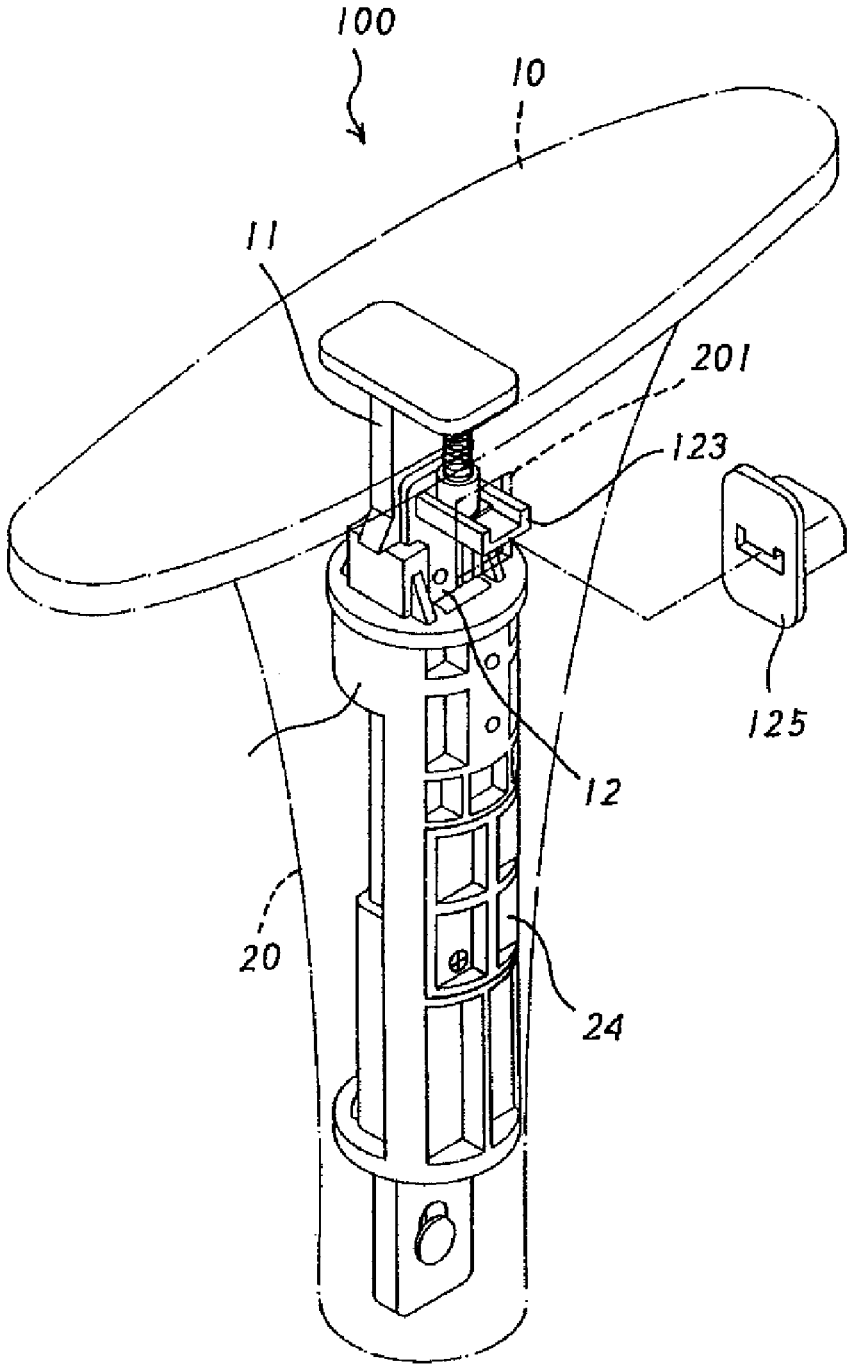
FIG. 3 is a perspective view illustrating the adjusting member and the rail member being assembled together in an armrest.

In assembly, the adjusting member 1 having the engaging slot 111 formed therein is inserted into the rail member 2 so that the lock projection 22 is correspondingly retained in the engaging slot 111 of the adjusting member 1 and the toothed groove 121 of the rail member 2. Thereafter, the top end of the adjusting member 1 is disposed against a plate member 10, and the rail member 2 is secured in a support member 20 such that the push button 123 extends out of an opening 201 provided in the support member 20 (as shown in FIG. 3).

Figure 4:
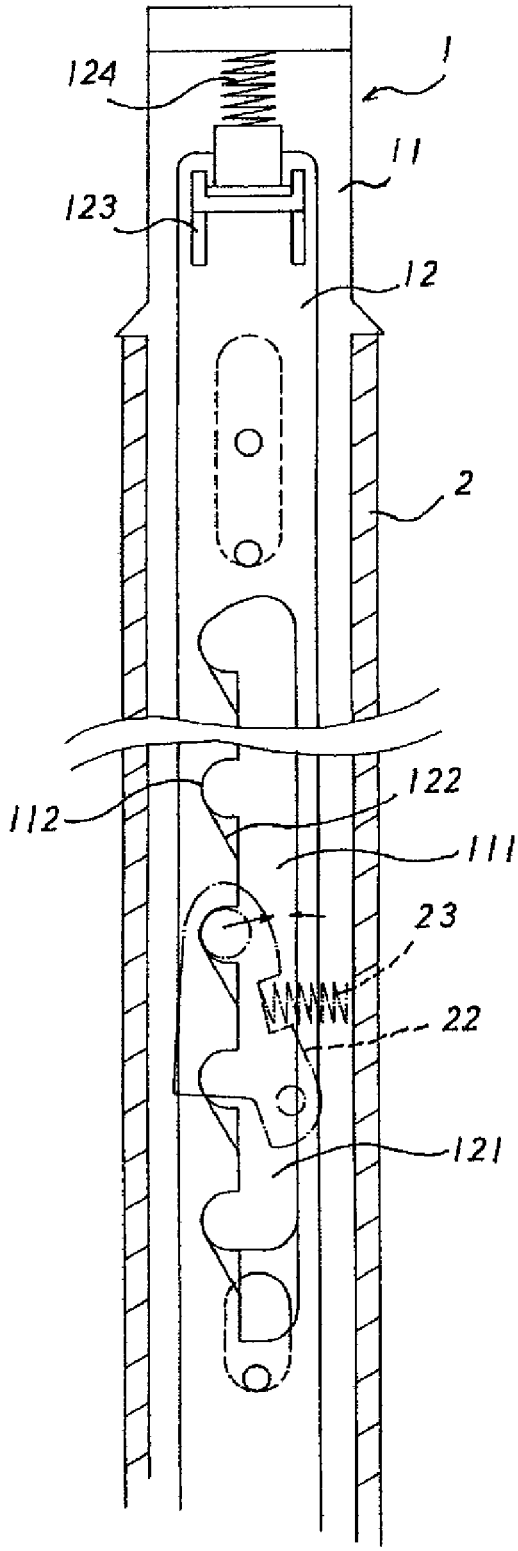
FIG. 4 is a cross sectional view illustrating the operation of the elevating structure for armrests according to the present invention.

In operation, since the lock projection 22 is pressed by the second spring 23, the lock projection 22 is biased toward one of the locking recesses 112 so the lock projection 22 retained in one of the locking recesses 112. Thus, the adjusting member 1 and the rail member 2 are positioned relative to each other (as shown in FIG. 4), to position the plate member 10 at a height. When desiring to adjust the height of the plate member 10, the push button 123 is pulled upward to press the first spring 124 so that the auxiliary part 12 slides upward in relation to the main part 11 (as illustrated in FIG. 5). Hence, the lock projection 22 retained in the locking recess 112 is urged by the inclined pushing surface 122 of the auxiliary part 12 to be released from the engagement from the locking recess 112, so that the adjusting member 1 can be adjusted vertically. Furthermore, after the adjusting member 1 is moved to a proper height, the push button 123 is released so that the auxiliary part 12 is biased by the first spring 124 to return the inclined pushing surface 122 of the auxiliary part 12 below the locking recess 112. Thereafter, the lock projection 22 is pushed by the second spring 23 to be engaged in the corresponding locking recess 112, thereby positioning the plate member 10 easily.

On the other hand, a fitting block 125 is correspondingly fitted onto the push button 123 for covering the opening 201, thus enhancing an aesthetic appearance.

The invention is not limited to the above embodiment but various modifications thereof may be made. It will be understood by those skilled in the art that various changes in form and detail may be made without departing from the scope and spirit of the present invention.

What is claimed is:

1. An elevating structure for armrests comprising:

an adjusting member;

a rail member for slideably receiving said adjusting member therein, wherein both of the adjusting and rail members are assembled together in an armrest, with said adjusting member including a main part and an auxiliary part moveable relative to each other;

with said main part having an engaging slot formed therein with a plurality of recesses, with a groove formed in said auxiliary part with a plurality of grooves corresponding to the plurality of recesses, wherein said auxiliary part includes a push button attached on a top end thereof and extending therefrom;

a first spring received in the push button and abutting against said main part to push the auxiliary part downward, with each groove of said auxiliary part provided with an inclined pushing surface;

said rail member slideably receiving said adjusting member and including a lock member pivotally mounted thereon about an axis; and a second spring pressing the lock member, wherein said lock member includes a lock projection parallel to and spaced from the axis and inserted into said rail member such that said lock projection is biased to engage with one of said locking recesses and be received in one of said plurality of grooves.

2. The elevating structure for armrests as claimed in claim 1, further comprising:

a fitting block fitted onto said push button for covering an opening in the armrest.

3. The elevating structure for armrests as claimed in claim 2 further comprising:

a window arranged in said rail member, with the lock projection inserted into said rail member through said window; and a lid closing the window and covering said lock member.

* * * * *